US006311420B1

(12) United States Patent
Wu

(10) Patent No.: US 6,311,420 B1
(45) Date of Patent: Nov. 6, 2001

(54) WATER SCREEN TYPE WATER BALL

(76) Inventor: Yin-Yin Wu, No. 2, Lane 9, Chin Fu Street, Chutung Town, Hsinchu Hsien (TW)

( * ) Notice: Subject to any disclaimer, the term of this patent is extended or adjusted under 35 U.S.C. 154(b) by 0 days.

(21) Appl. No.: 09/488,838

(22) Filed: Jan. 21, 2000

(51) Int. Cl.[7] ..... G09F 19/00
(52) U.S. Cl. ..... 40/406; 446/267
(58) Field of Search ..... 40/406, 407, 409, 40/410, 408, 412, 422, 439; 446/267

(56) References Cited

U.S. PATENT DOCUMENTS

| | | | | |
|---|---|---|---|---|
| 3,147,175 | * | 9/1964 | Gonzalez | 40/410 |
| 4,817,311 | * | 4/1989 | Ong | 40/410 |
| 5,098,084 | * | 3/1992 | Culver | 40/410 |
| 5,110,636 | * | 5/1992 | Hou | 40/410 |
| 5,174,239 | * | 12/1992 | Sato | 40/406 |
| 5,313,727 | * | 5/1994 | Murray, Jr. | 40/410 |
| 5,396,723 | * | 3/1995 | Liu | 40/406 |
| 5,442,869 | * | 8/1995 | McDarren et al. | 40/406 |
| 5,711,099 | * | 1/1998 | Nesbit et al. | 40/406 |
| 6,153,273 | * | 11/2000 | Lin | 40/406 |
| 6,161,317 | * | 12/2000 | Wang | 40/406 |

* cited by examiner

*Primary Examiner*—Lynne H. Browne
*Assistant Examiner*—Kenn Thompson
(74) *Attorney, Agent, or Firm*—Rosenberg, Klein & Lee

(57) ABSTRACT

The present invention relates to a water screen type water ball primarily comprising a base with an opening at the top thereof serving as a water container, and having a slotted locating surface at the top inner rim; moreover, a water pump is disposed in the middle of the bottom of the base, and the water raised by the water pump is transported through a water pipe upwards; an ornamental seat whose bottom edge is joined on the locating surface, and the inner rim is provided with a groove having at least one flow channel; in addition, a longitudinal through hole is disposed at the center of the ornamental seat in order for the water pipe to pass through; and a circular arc transparent hood with an downward opening whose circular arc cambers at the rim thereof are all identical, and the bottom thereof contracts to be a protruding flange which can be attached to the groove of the decorative object; furthermore, a small clearance has to be reserved between the inner rim of the transparent glass hood and the outlet end of the water pipe.

2 Claims, 5 Drawing Sheets

WATER SCREEN TYPE WATER BALL

BACKGROUND OF THE INVENTION

1. Field of the Invention

The present invention relates to an improvement of water ball, and more particularly, to a water ball with water screen design, wherein an ornamental object in the water ball can be prevented from being wetted, with effect of easy assembly and with long using life.

2. Description of the Prior Art

FIG. 1 is a schematic drawing of the structure of a conventional water ball which has a transparent glass hood 12 disposed at the top of a base 11 and filled with liquid 13 so that the ornamental object 14 at the top of the base 11 is presented in the liquid 13 and creates a dim beauty. However, the using life of the prior art ornamental object 14 is easily decreased after soaked in the liquid 13 for a long period. In order to increase the entertainment effect of the ornamental object 14 and to make the water ball more beautiful, the water ball is normally provided with light 15 on the ornamental object 14 or at the side thereof. However, the light 15 is situated in the water so that the water resistance has to be perfectly ensured; otherwise, a short circuit can lead to cause malfunctions by being wetted. Accordingly, the manufacturing of the prior art water ball 1 is time-wasted and inconvenient. Besides, the ornamental object 14 and the light 15 are soaked in the water for a long period, and it will be easily wetted and oxidized to reduce the using life, even to lead to frequent defects.

SUMMARY OF THE INVENTION

It is a primary object of the present invention to provide a water screen type water ball, wherein a water pipe is fitted at the center of the inner rim of the circular arc-shaped transparent hood, and a water post is raised through the water pipe by means of a pump at the base, and a small clearance has to be reserved between the inner rim of the transparent glass hood and the outlet end of the water pipe so that the water post can flow down along the inner rim of the transparent hood after outflow through the outlet; accordingly, the shape of a transparent water ball is presented.

It is a further object of the present invention to provide a water screen type water ball which can protect the ornamental object and the light inside of the glass hood from being wetted in order to prolong the using life thereof.

BRIEF DESCRIPTION OF THE DRAWINGS

The drawings disclose illustrative an embodiment of the present invention which serves to exemplify the various advantages and objects hereof, and are as follows.

DETAILED DESCRIPTION OF THE PREFERRED EMBODIMENT

Figure 1:
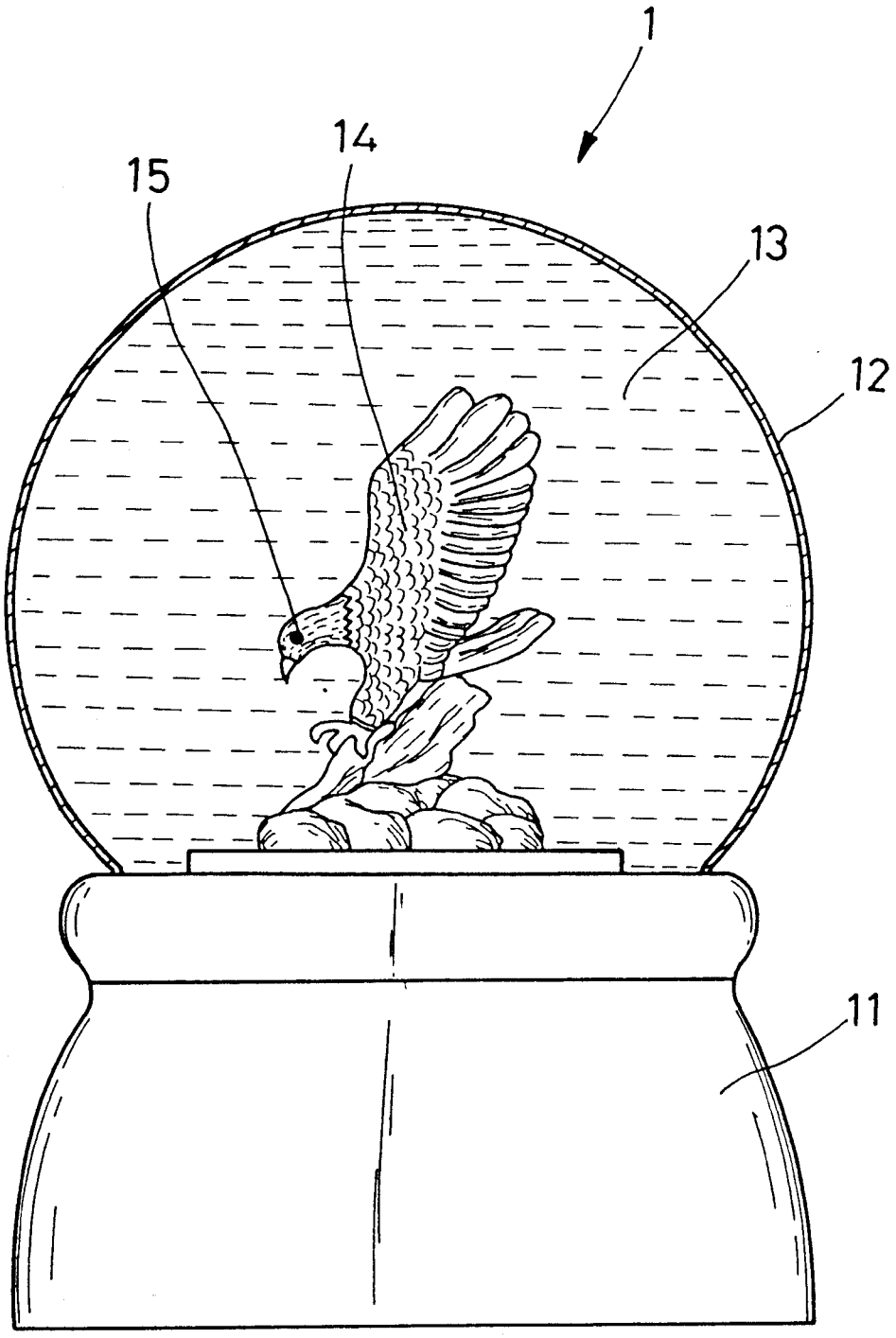
PRIOR ART FIG.1
FIG. 1 is a schematic drawing of the structure of a conventional water ball.
Figure 2:
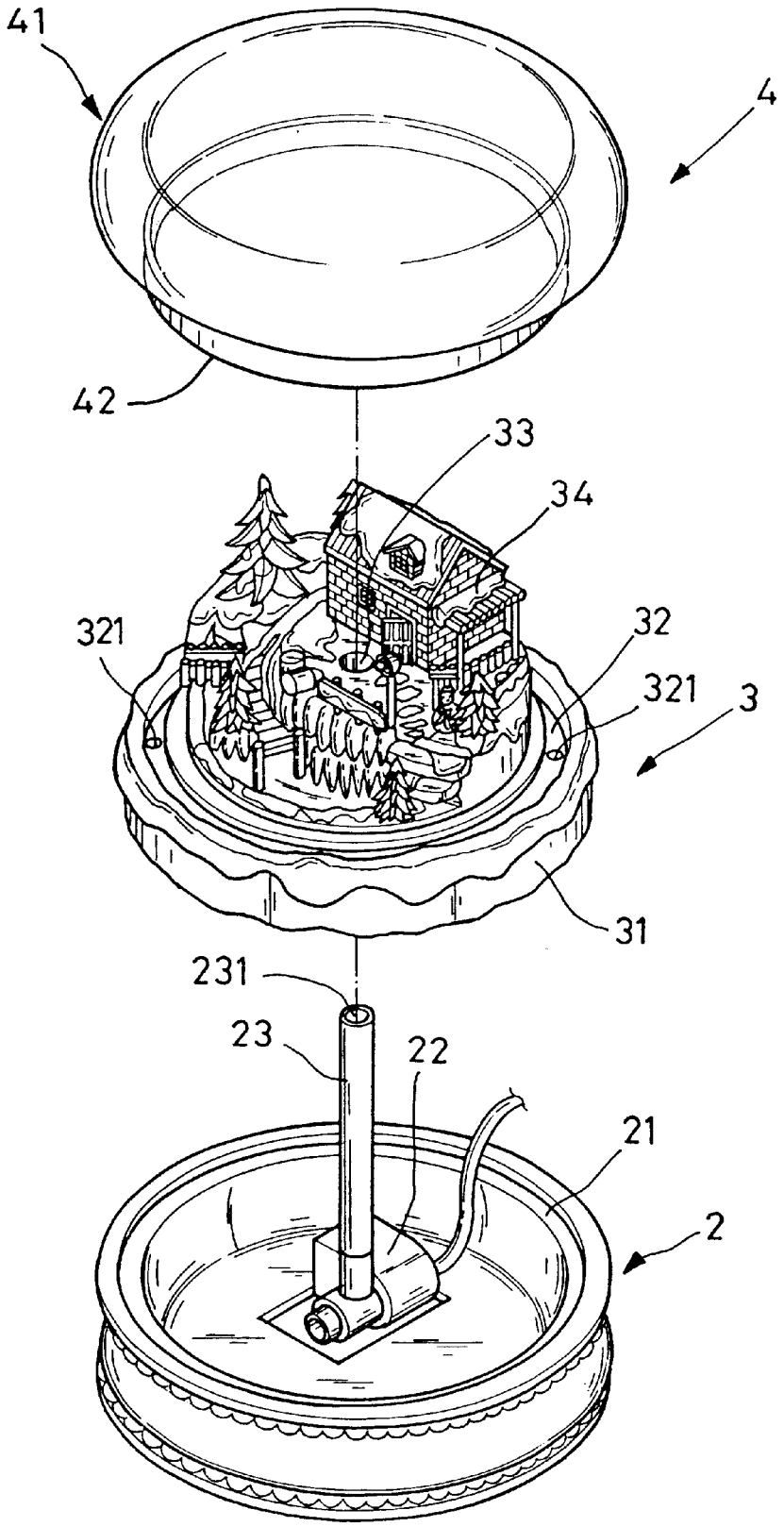
FIG. 2 is an exploded view of a preferred embodiment of the present invention.
Figure 3:
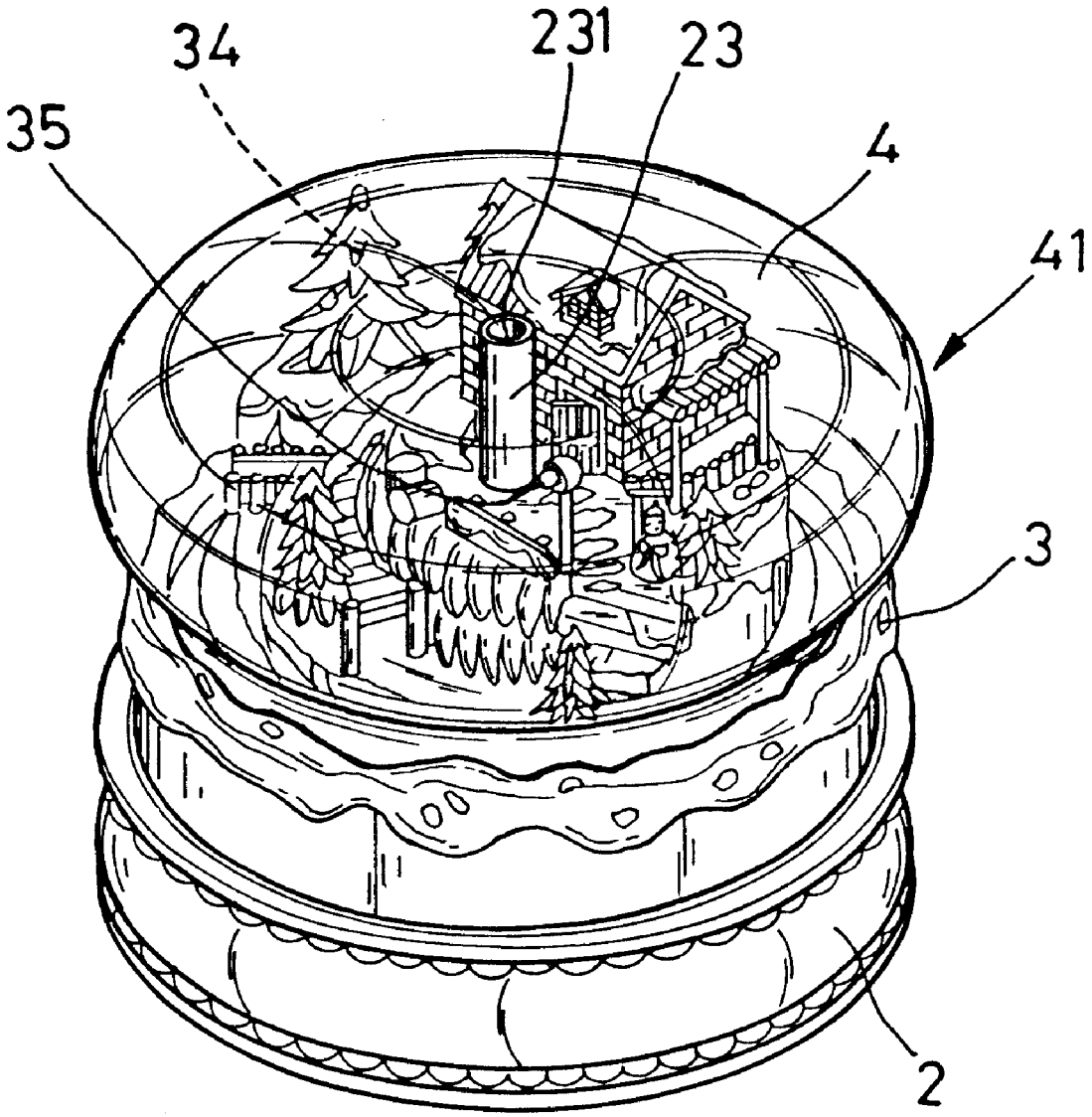
FIG. 3 is a perspective view of the preferred embodiment of the present invention.
Figure 4:
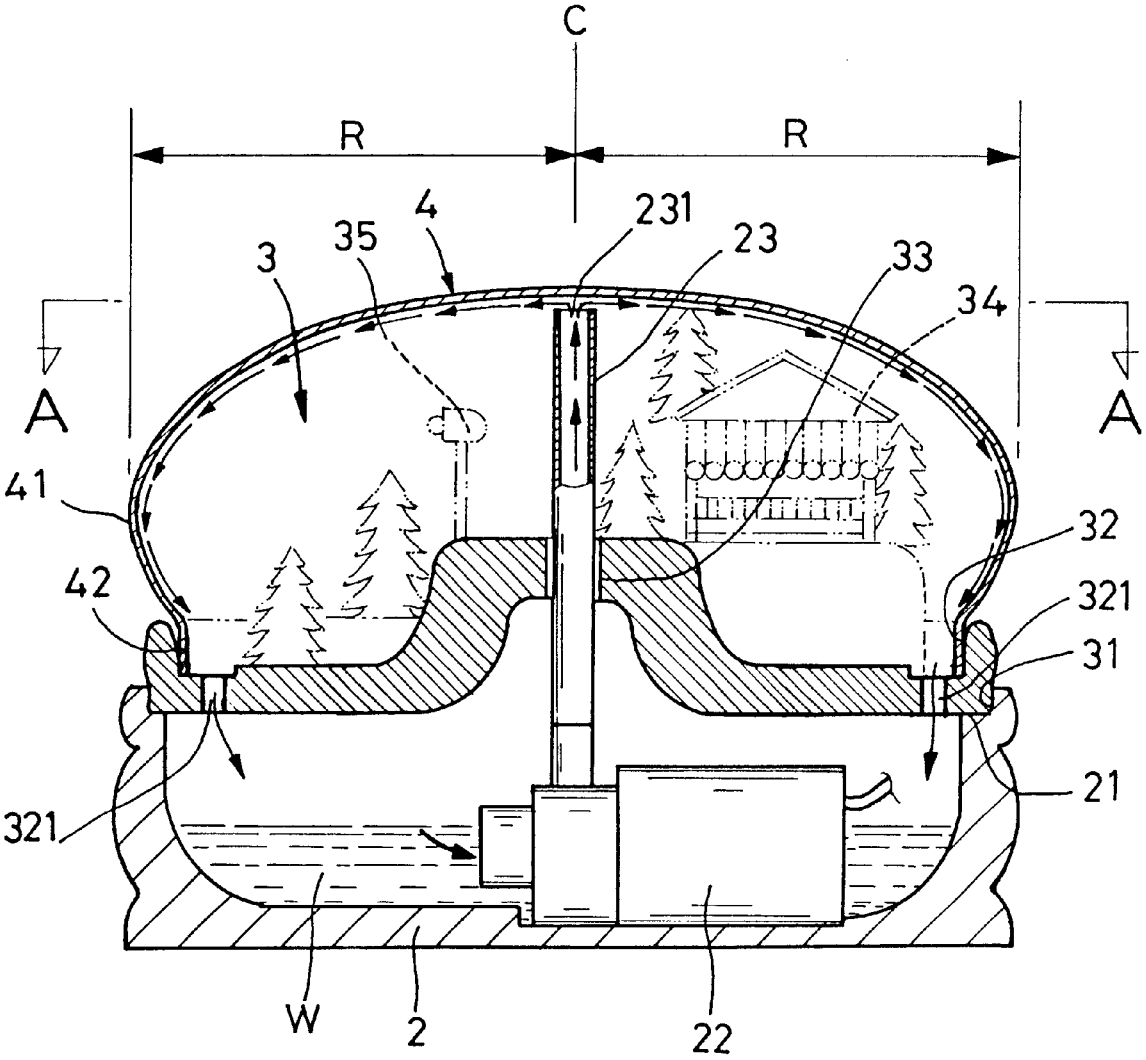
FIG. 4 is a cutaway view of the preferred embodiment of the present invention.

First of all, referring to FIGS. 2 through 4, the water screen type water ball in accordance with the present invention includes:

a base 2 with an opening at the top thereof serving as a water container, and having a slotted locating surface 21 at the top inner rim; moreover, a water pump 22 is disposed in the middle of the bottom of the base 2, and the water raised by the water pump 22 is transported through a water pipe 23 upwards;

an ornamental seat 3 whose bottom edge 31 is joined on the locating surface 21, and the inner rim is provided with a groove 32 having at least one flow channel 321; in addition, a longitudinal through hole 33 is disposed at the center of the ornamental seat 3 in order for the water pipe 23 to pass through; and a circular arc transparent hood 4 with an downward opening whose circular arc cambers 41 at the rim thereof are all identical, and the bottom thereof contracts to be a protruding flange 42 which can be attached to the groove 32 of the decorative object 3; furthermore, a small clearance has to be reserved between the inner rim of the transparent glass hood 4 and the outlet end 231 of the water pipe 23.

The top of the above-mentioned ornamental seat 3 can be fitted with ornamental object 34 and light 35.

Furthermore, the small clearance between the inner rim of the transparent glass hood 4 and the outlet end 231 of the water pipe 23 preferably amounts to 1 mm–3 mm. If the clearance is too small, the water can't flow out; and if too big, a reactive force will be created, and the water will disperse outward and no water screen can be produced.

Figure 5:
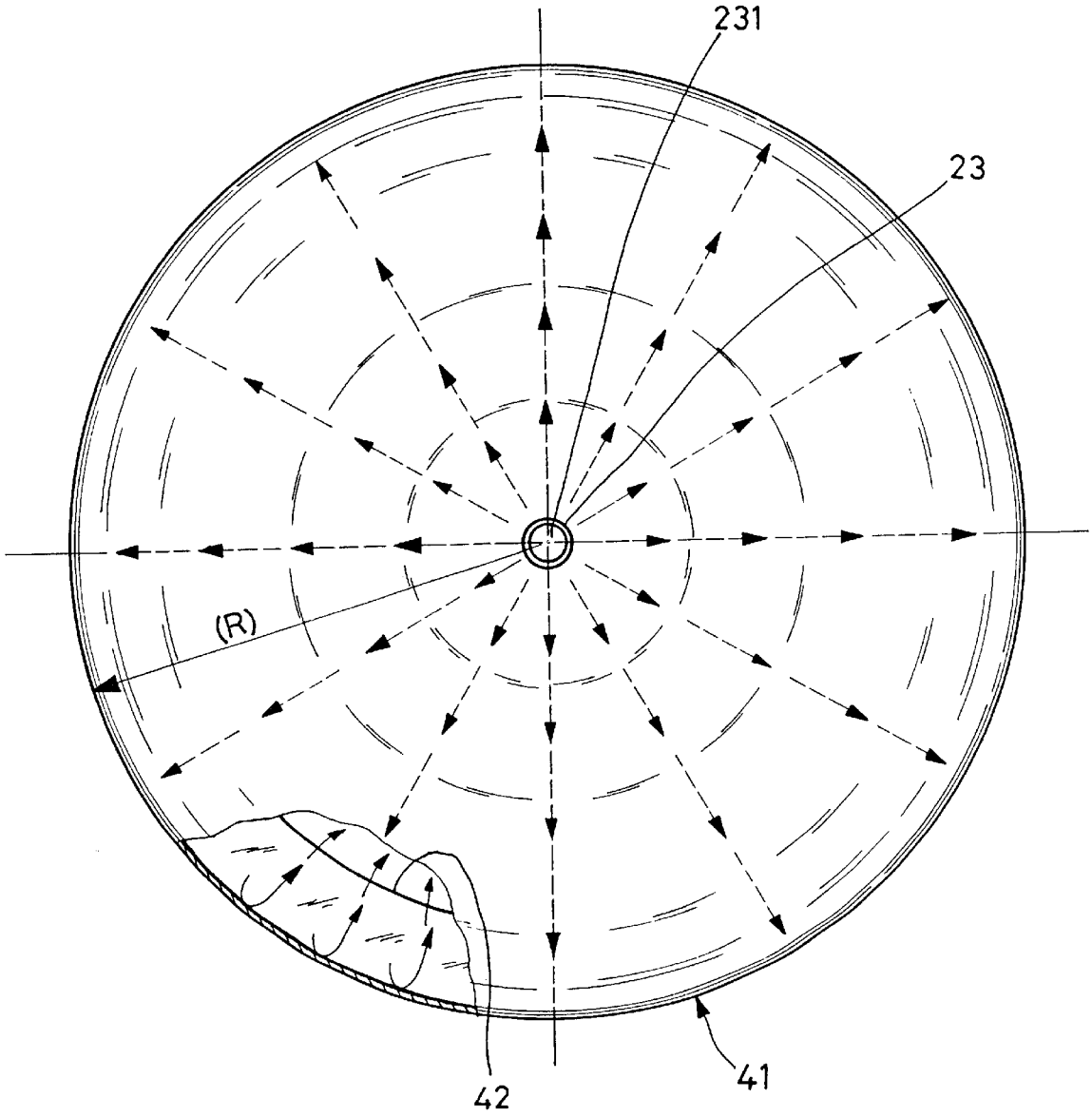
FIG. 5 is a schematic drawing taken along the line A—A of FIG. 4.

By means of the above-mentioned technique, the base 2 will be filled with water (w) of proper amount. When the water pump 22 is actuated, the water (w) will be raised through the water pipe 23 and flows upwards to the outlet end 231 at preset head. At that time, when the outflow rushes to the inner rim of the center of the transparent hood 4, the outflow water post will be attached to the inner rim of the transparent hood 4 by means of the flow force in accordance with features of fluid mechanics, and flows down in diffusion way in all directions, as shown in FIGS. 4 and 5. The circular arc cambers 41 all over the transparent hood 4 are identical and the radii between the central position (C) and the rim are equidistant so that the water will be well-distributed and diffused in all directions when the water post is raised through the water pipe 23 to the outlet end 231. Therefore, a water screen will be created on the surface of the transparent hood 4 as if the ornamental object 34 were situated in water ball when it is seen from outside. Thus, the flowing water screen is more mobile and interesting than the water ball.

Certainly, the water screen in accordance with the present invention flows down along the surface of the circular arc camber 41 at the inner rim of the transparent hood 4; thereafter, the water will be collected through the flow channel 321 back to the base 1. The water (W) won't touch the ornamental object 34 on the ornamental seat 3 during the formation of the water screen if the pumping head and the small clearance between the outlet end 231 of the water pipe 23 and the transparent hood 4 are well preset. Thus, people feel as if the ornamental object 34 were situated in water when it is seen from outside, and it will be kept dry. It's not required to worry about being wetted when the light 35 is mounted on the ornamental object 34. Accordingly, it doesn't require to fit a water-resistant device to the water ball, and the processing time and cost of the present invention can be saved; moreover, the using life can be prolonged.

Many changes and modifications in the above-described embodiment of the invention can, of course, be carried out without departing from the scope thereof. Accordingly to promote the progress in science and the useful arts, the invention is disclosed and is intended to be limited only by the scope of the appended claims.

What is claimed is:

1. A water screen type water ball primarily comprising:

a base with an opening at the top thereof serving as a water container, and having a slotted locating surface at the top inner rim; moreover, a water pump is disposed in the middle of the bottom of said base, and the water raised by said water pump is transported through a water pipe upwards;

an ornamental seat whose bottom edge is joined on said locating surface, and the inner rim is provided with a groove having at least one flow channel; in addition, a longitudinal through hole is disposed at the center of said ornamental seat in order for said water pipe to pass through; and a circular arc transparent hood with an downward opening whose circular arc cambers at the rim thereof are all identical, and the bottom thereof contracts to be a protruding flange which can be attached to said groove of the decorative object; furthermore, a small clearance has to be reserved between said inner rim of said transparent glass hood and said outlet end of said water pipe.

2. The water screen type water ball as claimed in claim 1, wherein the top of said ornamental seat can be fitted with ornamental object and light.

* * * * *